US005838644A

United States Patent [19]

Yoneda et al.

[11] Patent Number: 5,838,644

[45] Date of Patent: Nov. 17, 1998

[54] ELECTROLUMINESCENT DISPLAY AND LUMINOUS TIMEPIECE DIAL

[75] Inventors: Koji Yoneda; Koji Hirose; Shigehiko Aoki; Iwao Hirayama, all of Tokyo, Japan

[73] Assignee: Seiko Precision Inc., Japan

[21] Appl. No.: 549,091

[22] Filed: Oct. 27, 1995

[30] Foreign Application Priority Data

Oct. 27, 1994 [JP] Japan ..... 6-264031
Sep. 14, 1995 [JP] Japan ..... 7-236663

[51] Int. Cl.[6] ..... G04B 19/06

[52] U.S. Cl. ..... 368/232; 368/239; 368/228

[58] Field of Search ..... 368/231, 80, 83, 368/228–230, 232, 239

[56] References Cited

U.S. PATENT DOCUMENTS

| | | | |
|---|---|---|---|
| 4,594,282 | 6/1986 | Kawaguchi et al. | 428/216 |
| 4,634,934 | 1/1987 | Tohda et al. | 315/503 |
| 4,717,859 | 1/1988 | Sohn | 313/503 |
| 4,777,099 | 10/1988 | Mimura et al. | 428/917 |
| 5,294,870 | 3/1994 | Tang et al. | 315/505 |
| 5,483,120 | 1/1996 | Murkami | 313/506 |
| 5,504,389 | 4/1996 | Dickey | 313/506 |
| 5,552,668 | 9/1996 | Hirose et al. | 313/506 |

FOREIGN PATENT DOCUMENTS

| | | |
|---|---|---|
| 357443 | 3/1990 | European Pat. Off. . |
| 4-367892 | 1/1992 | Japan . |
| 6-337647 | 12/1994 | Japan . |
| 937669 | 9/1963 | United Kingdom . |

*Primary Examiner*—Bernard Roskoski
*Attorney, Agent, or Firm*—Adams & Wilks

[57] ABSTRACT

An electroluminescent display which is simple to manufacture and which is capable of high luminance consists of a transparent electrode disposed on a transparent substrate. On the transparent electrode are sequentially laminated layers including a fluorescent print pattern layer, a luminescent layer, an insulating layer and a rear electrode layer. The fluorescent layer is preferably formed of a fluorescent pigment and a fluoride resin binder and is provided at a portion of the electroluminescent display at which a display is to be created, such as the time indicating indicia on the dial of a timepiece. In a preferred embodiment, the electroluminescent display is provided as a timepiece dial and has a central hole therethrough for providing shafts for driving an hour hand, a minute hand and a second hand. Upon application of an electric field between the display electrodes, portions of the luminescent layer other than those which correspond to the time indicia emit light with a luminescent color dependent upon the material of the luminescent layer. The luminescent color becomes the background color of the dial. The time indicia portion formed of the patterned fluorescent layer produces secondary luminescence in response to the light emitted by the luminescent layer and received by the fluorescent layer, such that the printed time indicia emits fluorescent light with a bright fluorescent color in contrast with the luminescent background color.

19 Claims, 2 Drawing Sheets

ELECTROLUMINESCENT DISPLAY AND LUMINOUS TIMEPIECE DIAL

FIELD OF THE INVENTION

The present invention relates to an electroluminescent display device and to a luminous dial using the same.

BACKGROUND INFORMATION

Electroluminescent ("EL") displays are widely used for display of characters, pictorial designs or other indicia. A conventional method for producing EL display devices involves the printing of an ordinary coating material onto the surface of a transparent substrate of an EL panel (as disclosed, for example, in U.S. Pat. No. 4,775,964). In addition, a method of forming characters, pictorial designs or other indicia on a decorative light transmission sheet separately from the EL panel by, for example, printed coating material is also known.

In accordance with these conventional EL display device fabrication methods, since a coating material must be printed on the surface of the transparent substrate of the EL panel, it is necessary to perform the printing of the coating material as a separate process after having manufactured a complete EL panel by screen printing or the like. For this reason, the conventional manufacturing process is overly complex. Usually, when forming an EL panel, each relevant layer is sequentially laminated on a transparent electrode deposited on a transparent substrate. The step of printing the coating material on the transparent substrate of the EL panel, however, necessitates inverting the EL panel and performing printing on the opposite side thereof after the previous laminating procedures. As a result, it is impossible to perform this coating step as one of a series of continuous coating operations.

Moreover, since characters, pictorial designs, or other graphical indicia are formed on the light transmission sheet as a separate member from an EL panel, the conventional manufacturing process is further complicated since it requires the execution of yet an additional step for bonding the light transmission sheet to the EL panel. In addition to the. complications arising in the fabrication process, since the luminescent surface of the EL panel is bonded to the light transmission sheet by an adhesive material, a decrease in luminance is unavoidable due to interference caused at the interface of each layer and the bonding adhesive. This problem becomes pronounced when the EL display device is to be driven at a low voltage such as, for example, when the EL panel is used as the dial of a battery-powered timepiece. In such a device, even a slight decrease in the overall luminance of the EL device becomes a significant source of increased power drainage.

Further, in the above-described conventional fabrication technique, since indicia such as numerals or the like are formed of a non-luminescent material, although the EL panel per se emits light of relatively high luminance, such numerals or the like do not emit any light. Therefore, the display of such numerals is generally flat or planar in appearance with the result that the decorative properties of the display become somewhat inferior.

SUMMARY OF THE INVENTION

In view of the above drawbacks of the conventional EL display device and the manufacturing process thereof, it is an object of the present invention to provide a simplified manufacturing process for an EL display device.

It is another object of the present invention to provide an improved EL display device which can produce a visually desirable display with no decrease in luminance, and to provide a decorative luminous dial using this EL display.

In order to achieve the foregoing objects and others, which will become apparent to those of ordinary skill in the art, a manufacturing process for an EL display is provided in the present invention in which a transparent substrate is formed with a transparent electrode disposed on one surface thereof. The transparent electrode has sequentially laminated thereon a series of layers including a print pattern layer formed into a desired display pattern such as characters, a pictorial design or other indicia, a luminescent layer containing a luminescent material, an insulating layer containing a highly dielectric material, and a rear electrode.

Preferably, a fluorescent layer containing a fluorescent pigment or fluorescent dye is utilized in the print pattern layer. In this case, when an electric field is applied between the transparent electrode and the rear electrode, the fluorescent layer produces a secondary luminescence in response to the primary light emission of the luminescent layer to thereby provide a fluorescent display of the patterned indicia in a color different from that of other portions of the display.

In a preferred embodiment of the present invention, the EL display is provided with a central hole through which an indicator hand shaft having indicator hands secured thereto passes, such that the EL display can be utilized as a luminous dial for a timepiece.

DETAILED DESCRIPTION OF THE PREFERRED EMBODIMENTS

Preferred embodiments of the present invention will hereinafter be described in connection with the attached drawings.

Figure 1:
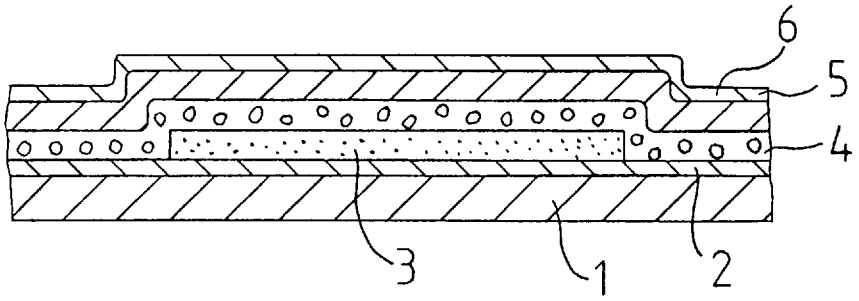
FIG. 1 is an enlarged sectional view illustrating an EL display in accordance with a first embodiment of the present invention.

As illustrated in FIG. 1, an EL display according to the present invention has a transparent electrode 2 which is formed by the deposition of indium tin oxide (ITO) on a transparent substrate 1. In order to provide the EL display with sufficient rigidity, the transparent substrate is formed, for example, of a plastic material such as polyethylene terephthalate (PET). On the transparent electrode 2 there are sequentially formed, by screen printing or the like, a fluorescent layer 3, which is patterned in a desired manner to form characters, a pictoral display, or other indicia, an electroluminescent layer 4, an insulating layer 5 and a rear electrode 6.

The rear electrode 6 is formed of a conductive material such as carbon paste. The insulating layer 5 is prepared by printing and drying an ink, for example, by mixing barium titanate ($BaTiO_3$) as a highly dielectric material with a fluoride resin binder. The electroluminescent layer 4 may be prepared by printing and drying an ink, for example, by mixing a luminescent material, such as a copper (Cu) doped zinc sulfide, with a fluoride resin binder. In this embodiment, the fluorescent layer 3 is adopted as the patterned indicia layer. The fluorescent layer 3 is prepared by printing and drying an ink, such as by mixing a fluorescent pigment and a fluoride resin binder. Preferably, the amount of fluorescent pigment contained in the mixture is such that the weight ratio thereof to the fluoride resin binder is greater than 3:10.

Figure 2:
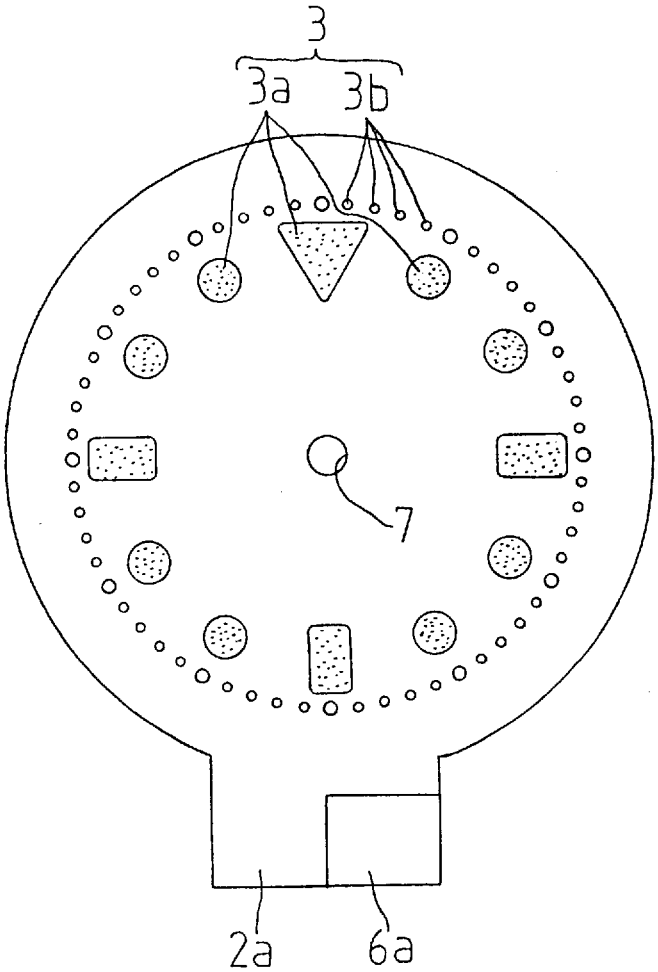
FIG. 2 is a front view illustrating an embodiment of the EL display used as a luminescent dial in a timepiece.
Figure 3:
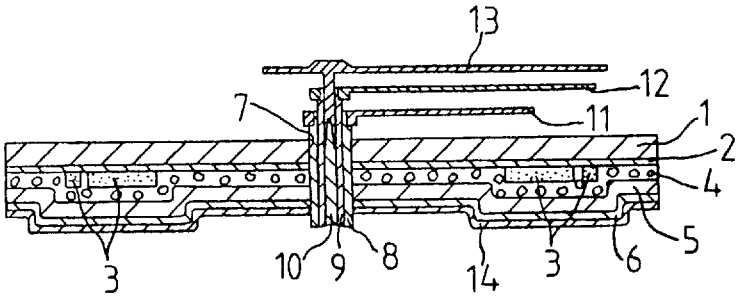
FIG. 3 is a sectional view illustrating essential components of a luminescent dial incorporated in a timepiece.

FIGS. 2 and 3 illustrate an embodiment in which the EL display of FIG. 1 is used as a dial for a timepiece. The transparent substrate 1 is formed into a dial configuration, and a hole 7 is formed at the center thereof. A lead portion 2*a* of the transparent electrode 2 and a lead portion 6*a* of the rear electrode 6 are provided to facilitate electrical contact. In addition, on the back of the rear electrode 6 there is provided by lamination a protective coating layer 14 made of a resin such as silicon, vinyl chloride, fluoride resin, urethane, butadiene rubber or the like.

As illustrated in FIG. 2, the fluorescent layer 3 is formed on the transparent electrode 2 on the rear surface of the transparent substrate 1, and the layer 3 is patterned, for example, in the form of twelve large markings 3*a* which serve as luminous hour divisions and sixty small dots 3*b* which serve as minute divisions. The EL display is formed into a circular dial configuration. When an electric field is applied thereto, the entire surface of the electroluminescent layer 4 emits light. Accordingly, the portion of the electroluminescent layer 4 having no fluorescent layer 3 thereon (the portion other than that having the time divisions) emits light with a luminescent color dependent upon the particular materials used in the electroluminescent layer 4, such as a blue-green color of the present embodiment. This luminescent color is also the background color of the dial. On the other hand, in the portion of the electroluminescent layer having the fluorescent layer 3 (the time division portion), the light emitted by the electroluminescent layer 4 enters the fluorescent layer 3 with the result that the fluorescent layer 3 emits light as a secondary luminescence.

In this embodiment, since a fluorescent pigment having fluorescent orange is used, the time division indicia emit light with high luminance in a fluorescent orange color in the ground color which becomes enhanced by the bluish-green color of the electroluminescent layer 4. At a time of non-luminescence, the portion having no fluorescent layer 3 thereon has an opalescent background color (the color of the base material of the electroluminescent layer) and the time division indicia have an orange color, which, as noted above, is the color of the fluorescent pigment when no luminescence occurs (the orange color with no brilliance as compared with the fluorescent orange color emitted when luminescence occurs). Since the fluorescent layer 3 can be easily formed by, for example, a screen printing technique, a display pattern of any desired complexity can be easily obtained.

As described above, a fluoride resin binder is used in the fluorescent layer, the electroluminescent layer 4 and the insulating layer 5. This is for the purpose of reducing the amount of water entering into the luminescent material of the luminescent layer by including therein a fluoride resin binder having a high moisture resistance to thereby prevent degradation of the respective layers due to hydrolysis. This eliminates the necessity of sealing the EL device with a moisture-proof film. Accordingly, it is possible to use the electroluminescent layer as an electroluminescent area up to the inner peripheral end of the hole 7.

As illustrated in FIG. 3, an hour hand shaft 8, a minute hand shaft 9 and a second hand shaft 10, each of which extends from a timepiece movement (not illustrated) pass through the hole 7 of the EL dial which consists of the EL display wherein the transparent substrate 1, transparent electrode 2, fluorescent layer 3, electroluminescent layer 4, insulating layer 5, rear electrode 6 and protective coating layer 14 are laminated, and each of these shafts projects therefrom. An hour hand 11, a minute hand 12 and a second hand 13 are respectively secured to the indicator hand shafts 8, 9 and 10. Each of these hands is driven by the timepiece movement (not illustrated) and is rotated in front of the EL dial illustrated in FIG. 2 to thereby indicate time.

Various combinations of luminescent colors are possible by simply changing the type of luminescent material contained in the luminescent layer 4, or the type of fluorescent pigment or dye contained in the fluorescent layer 3. Further, by including pigments or dyes (including fluorescent pigments or dyes) in the luminescent layer 4 as well, variations in the luminescent color can be increased and simultaneously the tint of the background color can also be varied.

Although in the above-mentioned embodiment a fluorescent layer 3 containing fluorescent pigment or dye is used as the patterned indicia layer, the present invention is not limited thereto. For instance, the patterned indicia may be formed of an ordinary ink containing a dye, a pigment, or the like (including light shielding and semi-transparent materials) having no fluorescence characteristics. In this case, display by a tint peculiar to this print pattern layer is made on the luminescence color surface of the luminescent layer 4. When part of the print pattern layer is formed by the same fluorescent layer as in the case of the above-mentioned embodiment and the remainder thereof is formed by an ordinary ink layer, it is possible to obtain wider variations in the display. As mentioned above, in the present invention, by adopting various constructions as that of the print pattern layer, it is possible to widen the scope of variations in the display.

The content of the display made by the print pattern layer is not limited to time division indicia as described in the above-mentioned embodiment. As will be appreciated, it is also possible to display characters, pictures, or any other type of printed indicia. In addition, the EL display according to the present invention can be applied not only to a timepiece dial but also to any desired type of display.

In accordance with the present invention, since the patterned indicia is provided as an inside layer of the EL display, it is possible to make a desired configuration of display with a color different from the background luminescence color without performing any additional processes subsequent to the production of the EL display. Thus, the inventive manufacturing process is not only simple to execute but there is no likelihood that brightness decreases as it does when using a filter in the conventional process.

In addition, when the fluorescent layer 3 is provided as the patterned indicia layer, the display configuration emits bright light with a fluorescent foreground color in contrast to the luminescent background color of the luminescent material. Therefore, the EL display is very attractive and has excellent visual recognizability and is therefore suitable for use in a luminescent dial in which a visually pleasing and highly recognizable display is demanded, as in the case of a timepiece dial.

We claim:

1. An electroluminescent display comprising: a transparent substrate; a transparent electrode formed on a surface of the transparent substrate; a decorative pattern layer comprised of a fluorescent material formed directly on a surface of the transparent electrode opposite the transparent substrate; an electroluminescent layer formed on the transparent electrode and covering the decorative pattern layer; an insulating layer formed on the electroluminescent layer; and a rear electrode formed on the insulating layer.

2. An electroluminescent display according to claim 1; wherein the decorative pattern layer is formed into a desired design pattern.

3. An electroluminescent display according to claim 1; wherein the decorative pattern layer has a color different from that of the electroluminescent layer.

4. An electroluminescent display according to claim 1; wherein the fluorescent material is comprised of a mixture of a fluorescent pigment and a fluoride resin binder.

5. An electroluminescent display according to claim 4; wherein the weight ratio of fluorescent pigment to the fluoride resin binder is greater than 3:10.

6. An electroluminescent display according to claim 2; wherein the fluorescent material is comprised of a mixture of a fluorescent pigment and a fluoride resin binder.

7. An electroluminescent display according to claim 6; wherein the weight ratio of fluorescent pigment to the fluoride resin binder is greater than 3:10.

8. An electroluminescent display according to claim 2; wherein the decorative pattern layer has a color different from that of the electroluminescent layer.

9. An electroluminescent display comprising: a transparent substrate; a first transparent electrode formed on a surface of the transparent substrate; a decorative pattern layer comprised of a fluorescent material formed over the first transparent electrode; an electroluminescent layer formed over the decorative pattern layer; an insulating layer formed over the electroluminescent layer; and a second electrode formed over the insulating layer.

10. An electroluminescent display according to claim 9; wherein the electroluminescent layer comprises a first portion formed directly on the fluorescent layer and a second portion formed directly on the first transparent electrode.

11. An electroluminescent display according to claim 9; wherein the fluorescent material is formed directly on the first transparent electrode.

12. An electroluminescent display according to claim 9; wherein the fluorescent material has a color different from that of the electroluminescent layer.

13. An electroluminescent display according to claim 9; wherein the fluorescent material is comprised of a mixture of a fluorescent pigment and a fluoride resin binder.

14. An electroluminescent display according to claim 13; wherein the weight ratio of fluorescent pigment to the fluoride resin binder is greater than 3:10.

15. In a timepiece: movable indicator hands; a timepiece movement for driving the indicator hands in timed relationship; and a dial comprised of a transparent substrate, a first transparent electrode formed on a surface of the transparent substrate, a decorative pattern layer comprised of a fluorescent material formed over the first transparent electrode, an electroluminescent layer formed over the decorative pattern layer, an insulating layer formed over the electroluminescent layer, and a second electrode formed over the insulating layer.

16. A timepiece as set forth in claim 15; wherein the decorative pattern layer is formed into time indicating indicia which coact with the indicator hands to indicate time when the indicator hands are driven by the timepiece movement.

17. A timepiece as set forth in claim 15; wherein the decorative pattern layer has a color different from that of the electroluminescent layer.

18. A timepiece as set forth in claim 15; wherein the fluorescent material is comprised of a fluorescent pigment and a fluoride resin binder.

19. A timepiece as set forth in claim 18; wherein the weight ratio of fluorescent pigment to the fluoride resin binder is greater than 3:10.

* * * * *